US006213199B1

(12) United States Patent
Al-Khateeb

(10) Patent No.: US 6,213,199 B1
(45) Date of Patent: Apr. 10, 2001

(54) TEMPERATURE SELECTABLE WATER SUPPLY DEVICE

(76) Inventor: Osama Othman Mostaeen Al-Khateeb, P.O. Box 2145, Safat (KW), 13022

( * ) Notice: Subject to any disclaimer, the term of this patent is extended or adjusted under 35 U.S.C. 154(b) by 0 days.

(21) Appl. No.: 09/293,913

(22) Filed: Apr. 19, 1999

(51) Int. Cl.[7] ..... F25B 29/00

(52) U.S. Cl. ..... 165/258; 165/253; 165/288; 165/48.1; 165/61; 165/63; 165/64; 165/236; 62/393; 62/394; 222/146.1

(58) Field of Search ..... 165/236, 63, 64, 165/61, 88, 48.1, 50, 300, 65, 66, 253, 258, 288; 62/394, 399, 393, 391

(56) References Cited

U.S. PATENT DOCUMENTS

| | | | | |
|---|---|---|---|---|
| 1,726,093 | * | 8/1929 | Williams | 62/393 |
| 2,102,940 | * | 12/1937 | Buchanan | 165/48.1 |
| 2,495,878 | * | 1/1950 | Tull | 62/399 |
| 2,496,466 | * | 2/1950 | Graham | 165/299 |
| 2,767,960 | * | 10/1956 | Fast | 165/65 |
| 2,784,879 | * | 12/1957 | Fischer | 222/146.1 |
| 2,819,044 | * | 1/1958 | Bungas | 165/236 |
| 2,912,142 | * | 11/1959 | Schultz | 222/146.1 |
| 2,917,287 | * | 12/1959 | Tryon | 165/236 |
| 3,055,810 | * | 9/1962 | Skow | 222/146.1 |
| 3,227,207 | * | 1/1966 | Litman | 62/394 |
| 3,338,065 | * | 8/1967 | Ashley . | |
| 3,447,560 | * | 6/1969 | Dodson et al. | 222/146.1 |
| 3,493,037 | * | 2/1970 | Haake | 165/300 |
| 3,495,612 | * | 2/1970 | Moreland II et al. | 62/394 |
| 4,129,178 | * | 12/1978 | Hucke | 165/50 |
| 4,680,944 | * | 7/1987 | Menzel | 165/61 |
| 4,792,059 | * | 12/1988 | Kerner et al. | 222/146.1 |
| 5,823,007 | * | 10/1998 | Chang | 222/146.1 |
| 6,003,595 | * | 12/1999 | Watanabe | 165/300 |
| 6,044,903 | * | 4/2000 | Heilman et al. | 165/300 |

FOREIGN PATENT DOCUMENTS

| | | | | |
|---|---|---|---|---|
| 0431760 | * | 6/1991 | (EP) | 165/48.1 |
| 454272 | * | 1/1950 | (IT) | 165/61 |
| 627560 | * | 11/1961 | (IT) | 62/399 |
| 0013315 | * | 1/1986 | (JP) | 165/65 |

* cited by examiner

*Primary Examiner*—John K. Ford
(74) *Attorney, Agent, or Firm*—Michael I. Kroll

(57) ABSTRACT

A temperature selectable water supply device for one of heating and cooling water provided by a water supply system to an outlet in a structure. The device includes a main water tank including an inlet conduit for receiving water from a water supply tank connected to the water supply system and an outlet conduit for supplying the water to the outlet connected thereto. The temperature selectable water supply device also includes a water refrigeration tank connected to receive water from the main water supply tank for cooling to a desired temperature. A heating device is connected to the main water supply tank for heating the water therein and a cooling device is connected to the water refrigeration tank for cooling the water received thereby. A return conduit is connected between the water refrigeration tank and the main water tank for returning the cooled water to the main water tank for mixing with the water therein and thereby cooling the water. A hot water thermostat is connected to the main water tank for measuring a temperature of the water therein and activating the heating device to heat the water when the measured temperature is below a first predetermined adjustable value. A cold water thermostat is connected to the cooling cycle for measuring a temperature of the water within the main water supply tank and activating the cooling device when the measured temperature is above a second predetermined adjustable value.

10 Claims, 5 Drawing Sheets

COLD WATER OPERATION
COOLING CYCLE ON

HOT WATER OPERATION
COOLING CYCLE OFF

HOT WATER OPERATION
DURING TIMER CONTROLLED
MAINTENANCE COOLING CYCLE
(ON FOR AT LEAST 5 SECONDS
EVERY DAY IN WINTER)

TEMPERATURE SELECTABLE WATER SUPPLY DEVICE

BACKGROUND OF THE INVENTION

1. Field of the Invention

The present invention relates generally to boilers and, more specifically, to a compact apparatus positionable within any room of a structure for heating or cooling potable water supplied to that room wherein the heating or cooling of the water supply is selectively engaged based upon the temperature of the water desired by a user.

The device includes first and second water tanks and a controllable valve connected therebetween. The first water tank has a conduit for receiving water pumped from a main source of water and a conduit providing egress to the outlet to which it is connected. A heating device is contained within the first water tank along with a sensor for controlling the heating device. In addition, the first tank has a cooling sensor and conduit for extracting cold water from the second tank for delivery back to the first tank.

The second water tank is separated from the first water tank, and includes a water cooling device formed of an encircling refrigerant cooling coil connected to a compressor, a fan and a gas radiator. Cold water is selectively provided to the first water tank through a conduit connecting the first and second water tanks based upon the setting of a cooling thermostat having a sensor within the first water tank. In addition, the second water tank has a controllable valve connection to the first water tank for extracting water therefrom and delivery to the second tank for cooling prior to being returned to the first tank. A pump is connected to the second water tank for use in returning water back to the first tank. The use of the pump allows water to be supplied at a desired temperature to an outlet to which it is connected.

2. Description of the Prior Art

There may be other devices and methods employed for reducing the temperature within a building's water supply however none of these devices or methods are able to provide water of a desired temperature and pressure to an outlet such as a faucet or toilet connected thereto while also being compact in size and easily stored within the room to which the water is supplied. Furthermore, while these units may be suitable for the particular purpose to which they address, they would not be as suitable for the purposes of the present invention as heretofore described.

SUMMARY OF THE PRESENT INVENTION

The present invention relates generally to boilers and, more specifically, to a compact apparatus positionable within any room of a structure for heating or cooling potable water supplied to that room wherein the heating or cooling of the water supply is selectively engaged based upon the temperature of the water desired by a user.

A primary object of the present invention is to provide a temperature selective water supply device that will overcome the shortcomings of prior art devices.

A further object of the present invention is to provide a temperature selectable water supply device able to provide a supply of water having a user selectable temperature control to an outlet, e.g. a faucet, water tap or toilet, to which it is connected.

Another object of the present invention is to provide a temperature selectable water supply device which is easy to install and able to replace a conventional boiler positioned within a room of a structure and thereby provide both cooling and heating of water provided thereto.

A yet further object of the present invention is to provide a temperature selectable water supply device able to connect with a conventional pre-existing water tank to thereby provide water of a desired temperature to a desired outlet throughout the year regardless of the weather or air temperature.

A still further object of the present invention is to provide a temperature selectable water supply device able to switch between heating and cooling modes of operation by simply activating a switch.

An even further object of the present invention is to provide a temperature selectable water supply device having a first water supply tank and a second cold water tank.

A still further object of the present invention is to provide a temperature selectable water supply device having a first water supply tank including a device for heating the contents thereof and a second cold water tank having a device for cooling the contents thereof.

A yet further object of the present invention is to provide a temperature selectable water supply device having a first water supply tank and a second cold water tank, wherein the first water supply tank includes a device for cooling the water in the first water supply tank to a selectable temperature by injecting the contents of the second cold water supply tank into the first tank until the desired water temperature is obtained.

Additional objects of the present invention will appear as the description proceeds.

An apparatus for one of heating and cooling water provided by a water supply system to an outlet in a structure is disclosed by the present invention. The apparatus includes a main water tank including an inlet conduit for receiving water from a water supply tank connected thereto and an outlet conduit for supplying the water to the outlet connected thereto. The apparatus also includes a water refrigeration tank connected to receive water from the main water supply tank for cooling to a desired temperature. A heating device is connected to the main water supply tank for heating the water therein and a cooling device is connected to the water refrigeration tank for cooling the water received thereby. A return conduit is connected between the water refrigeration tank and the main water tank for returning the cooled water to the main water tank for mixing with the water therein and thereby cooling the water. A hot water thermostat is connected to the main water tank for measuring a temperature of the water therein and activating the heating device to heat the water when the measured temperature is below a first predetermined adjustable value. A cold water thermostat is connected to the cooling cycle for measuring a temperature of the water within the main water supply tank and activating the cooling device when the measured temperature is above a second predetermined adjustable value.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views.

Figure 4:
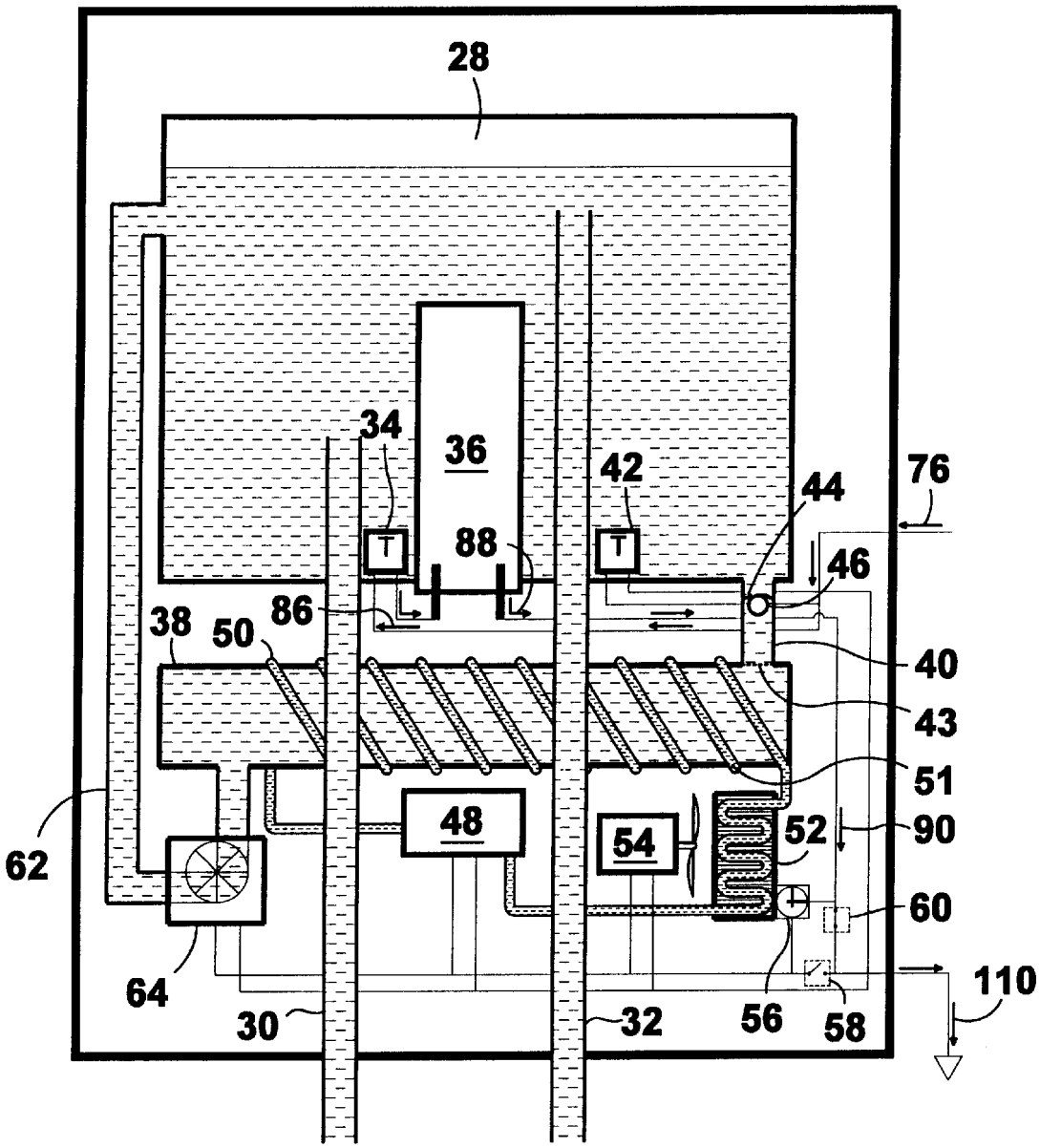
Figure 5:
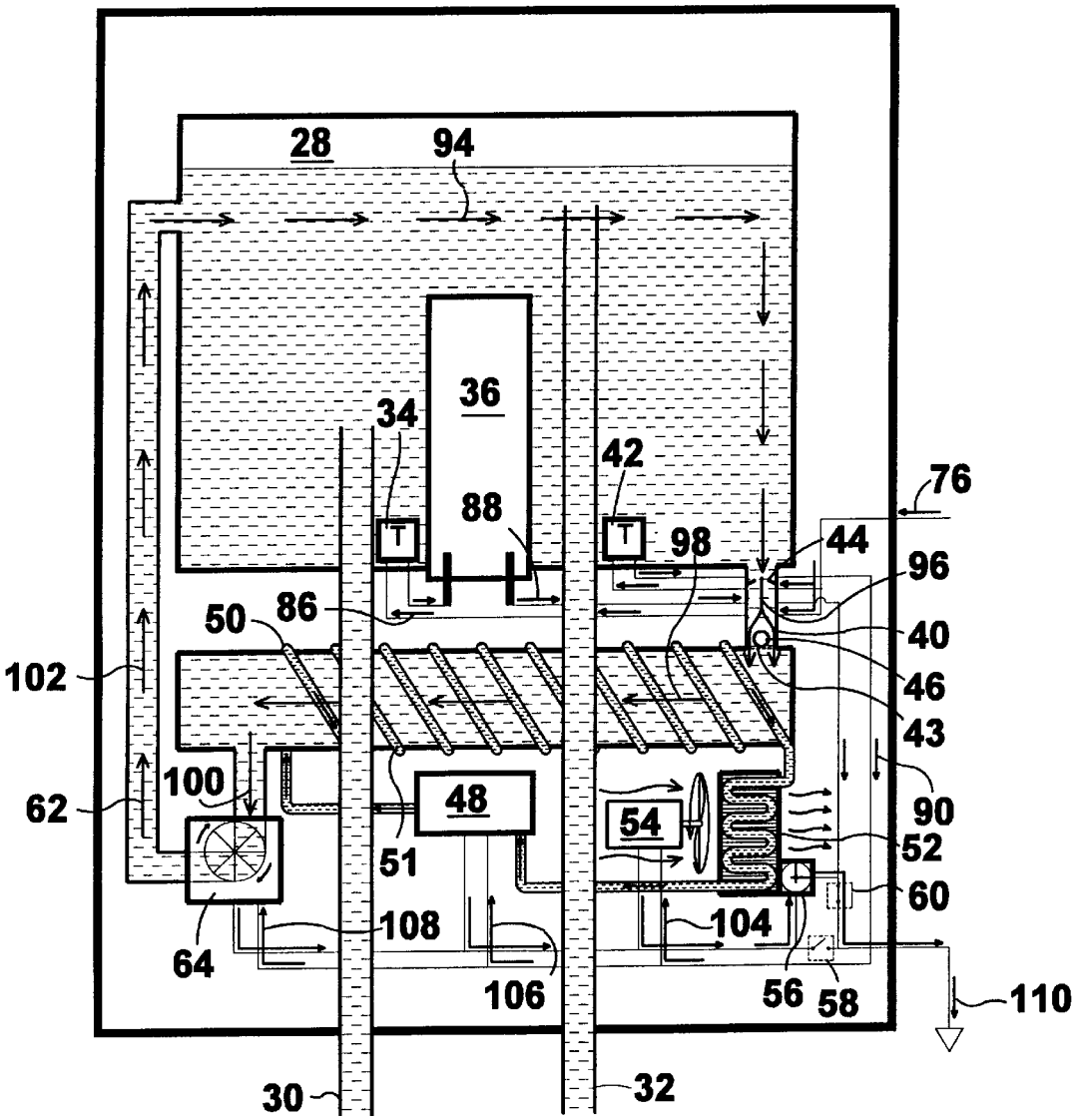

FIG. 4 is a representation of the hot water operating mode of the domestic water-cooling and heating appliance of the temperature selectable water supply device of the present invention with the maintenance cooling cycle off; and FIG. 5 is a representation of the hot water operating mode of the domestic water-cooling and heating appliance of the temperature selectable water supply device of the present invention with the maintenance cooling cycle on.

DESCRIPTION OF THE REFERENCED NUMERALS

Turning now descriptively to the drawings, in which similar reference characters denote similar elements throughout the several views, the Figures illustrate the temperature selectable water supply device of the present invention. With regard to the reference numerals used, the following numbering is used throughout the various drawing figures.

10 main water supply pipe line
11 water pump
12 main water tank on roof of structure
14 structure to which water is being supplied
16 water pipe connecting main water supply pipe line to water tank
18 pump for pumping water from water tank to the structure
20 temperature selectable water supply device of the present invention
21 bathroom in structure
22 kitchen in structure
24 network of pipes extending through structure
28 main water tank of temperature selectable water supply device
30 inlet water pipe
32 outlet water pipe
34 hot water thermostat
36 water heater
38 water refrigeration tank
40 conduit between main water tank and water refrigeration tank
42 cold water thermostat
43 float cage
44 valve seat
46 float valve
48 compressor motor
50 refrigerant cooling coil
51 refrigerant
52 refrigerant radiator
54 fan
56 timer
58 cold water cycle switch
60 hot water cycle switch
62 cold water pumping pipe
64 water pump
66 arrow indicating water within main water tank
68 arrow indicating water flowing through conduit
70 arrow indicating water flowing through water refrigerating tank
72 arrow indicating water flowing through water pump
74 arrow indicating water flowing through cold water pumping pipe
76 arrow indicating current supplied by power source
78 arrow indicating current flowing to cold water main switch
80 arrow indicating current flowing to fan
82 arrow indicating current flowing to water pump
86 arrow indicating current flowing to hot water thermostat
88 arrow indicating current flowing from water heater
90 arrow indicating current flowing to hot water cycle switch
94 arrow indicating water in main water tank
96 arrow indicating water flowing through conduit
98 arrow indicating water flowing through water refrigerating tank
100 arrow indicating water flowing through water pump
102 arrow indicating water flowing through cold water pumping pipe
104 arrow indicating current flowing to fan
106 arrow indicating current flowing to compressor motor
108 arrow indicating current flowing to water pump
110 voltoutput
112 arrow indicating current flowing to compressor

DETAILED DESCRIPTION OF THE PREFERRED EMBODIMENT

Figure 1:
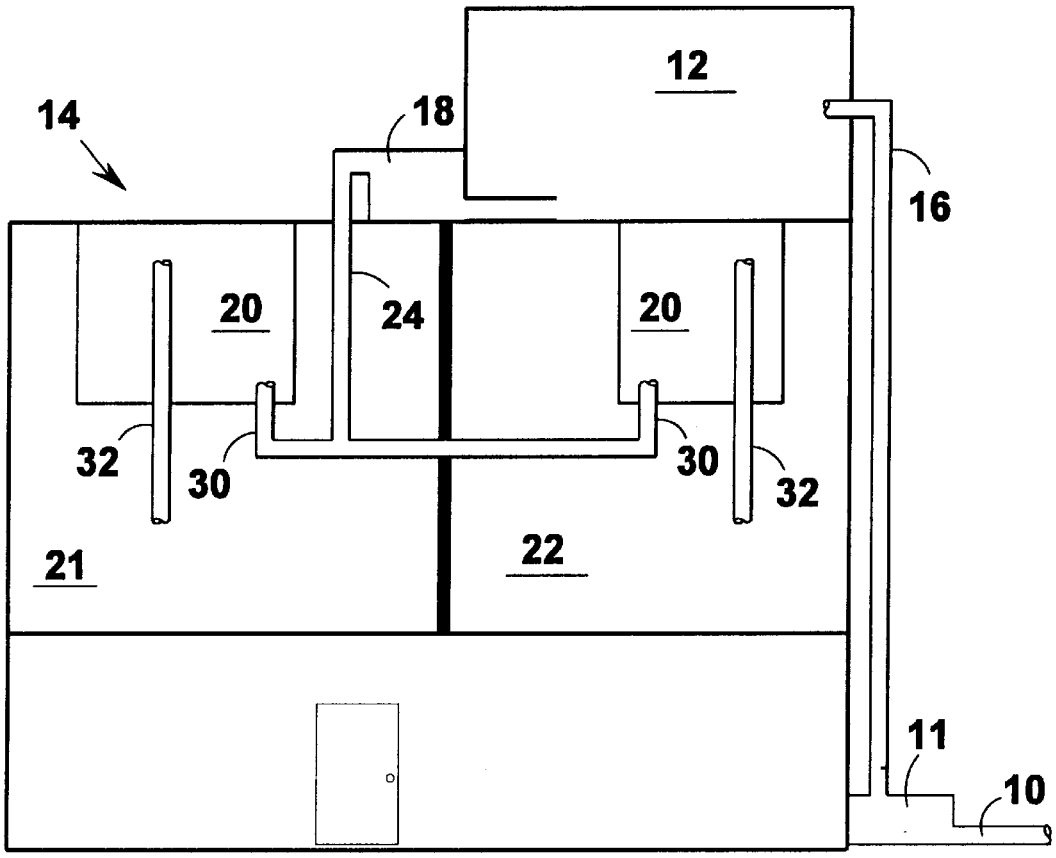
FIG. 1 is a diagrammatic view of a typical domestic water supply system for a structure found in tropical regions with the temperature selectable water supply device of the present invention positioned in select rooms of the structure and connected between the water supply system and an outlet therefor.
Figure 2:
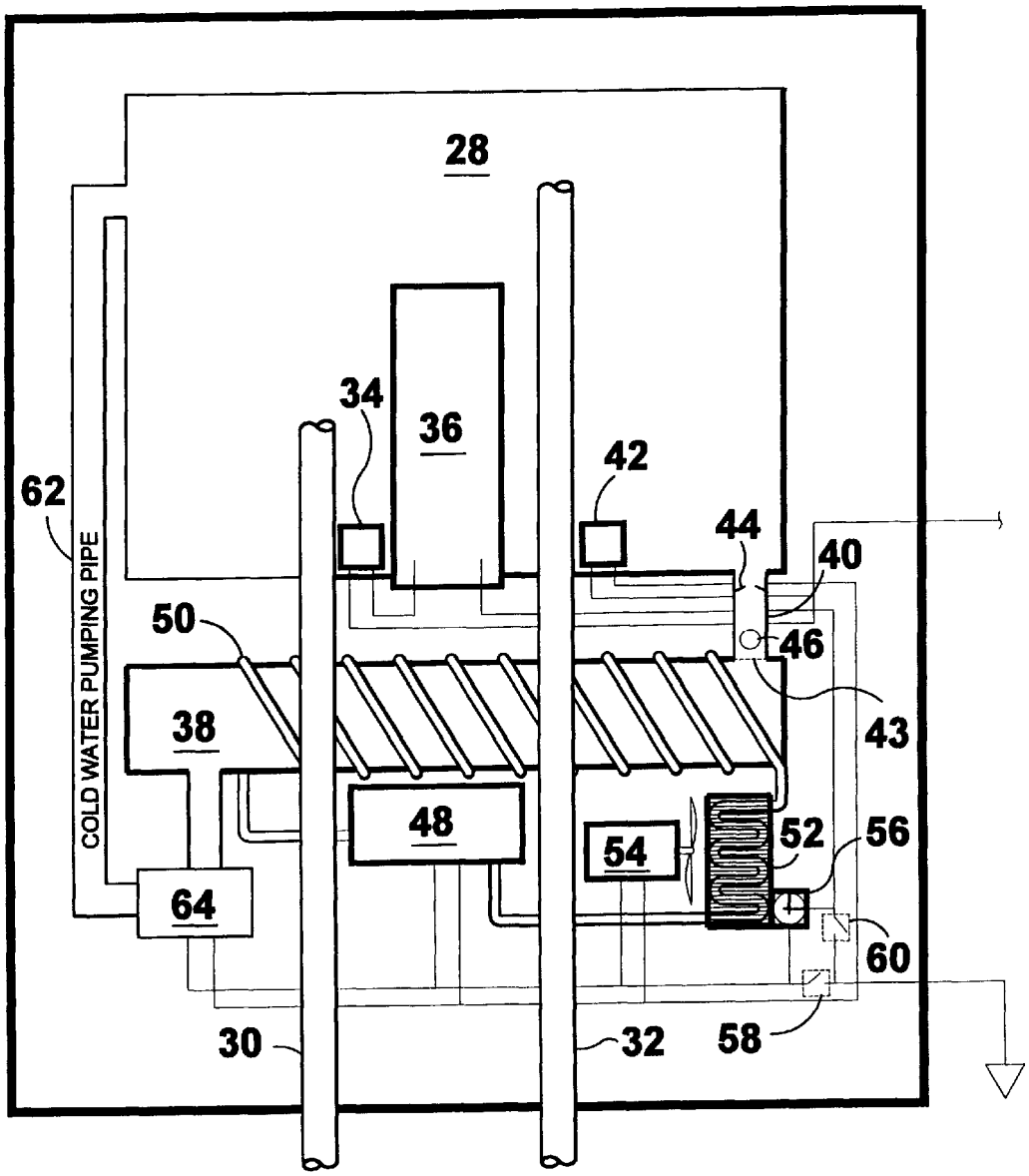
FIG. 2 is a diagrammatic view of the temperature selectable water supply device of the present invention showing the major components and connections therebetween.

Turning now descriptively to the drawings, in which similar reference characters denote similar elements throughout the several views, FIG. 1 illustrates a structure 14 including a conventional water supply system found in most structures in tropical and desert regions. This water supply system includes a main supply pipe line 10 connected to a water tank 12 positioned on the roof of the structure 14. The water tank 12 on the roof of the structure 14 receives water from the main water pipe 16 utilizing a pump 11 connected therebetween. The water in the water tank 12 on the roof of the structure 14 is provided to faucets, toilets and/or outlets to rooms such as a bathroom 21 and a kitchen 22 through a network of pipes 24 extending throughout the structure 14. A pump 18 is connected to the water tank 12 on the roof of the structure 14 to pump water from within the water tank 12 on the roof of the structure 14 to through the network of pipes 24. This system does not allow the user to manually adjust the temperature of the water and thus the temperature of the water is controlled at the water tank 12 on the roof of the structure 14 and is dependent upon the atmospheric conditions surrounding the water tank 12 on the roof of the structure 14. The water tank 12 on the roof of the structure 14 is normally positioned on the roof of the structure 14 and in the summer months is exposed to extreme heat due to sunlight. The exposure of the tank 12 on the roof of the structure 14 to sunlight can heat the water to high temperatures such as 45–55° Centigrade. Water at this temperature is too hot for many household uses. It is thus a problem to control the temperature of the water to within a useable or desired range.

The temperature selectable water supply device of the present invention indicated generally by the numeral 20 is positioned in any desired room of the structure and connected to the network of pipes 24 extending therein. The temperature selectable water supply device 20 is connected between the network of pipes 24 and an outlet to be serviced by the temperature selectable water supply device 20. As water is supplied from the water tank 12 on the roof of the structure 14 it is passed through the temperature selectable water supply device 20 wherein the temperature of the water is adjusted to a desired level and out of the outlet to which it is connected.

FIGS. 2 through 5 illustrate the temperature selectable water supply device 20 of the present invention, showing each element therein and illustrating the different modes of operation. The temperature selectable water supply device 20 is illustrated generally in FIG. 2. The temperature selectable water supply device 20 includes a main water tank 28 connected to receive water from the water tank 12 on the roof of the structure 14 through a water inlet pipe 30. A water outlet pipe 32 is provided extending from the main water tank 28 for supplying water directly from the main water tank 28 to the outlet served thereby. Water is pumped from the water tank 12 on the roof of the structure 14 through the water inlet pipe 30 into the main water tank 28 by the pump 18. A hot water thermostat 34 is connected to the main water tank 28 for measuring the temperature of water within the main water tank 28. A water heater 36 is connected to both the main water tank 28 and the thermostat 34. A switch 60 is connected to the hot water thermostat 34 for manually or automatically turning the hot water heater 36 on and off when the temperature of the water in the main water tank 28 is below a predetermined value set by the hot water thermostat 34. The predetermined temperature value is adjustable to change the temperature at which the water should be heated. When the switch 60 is closed, the hot water heater 36 is turned on and heats the water within the main water tank 28. Should this measured temperature rise above the adjustable preset temperature, the switch 60 is opened and the water heater 36 is turned off.

The device 20 also includes a water refrigeration tank 38 connected to the main water tank 28 through a conduit 40. A cold water thermostat 42 is connected to the main water tank 28 and a valve seat 44 is positioned in the conduit 40. A float cage 43 is positioned at a connection between the conduit 40 and water refrigeration tank 38 for retaining a float valve 46 within the conduit 40. A switch 58 is connected to the cold water thermostat 42 for manually or automatically initiating extraction of water from within the main water tank 28 and into the water refrigeration tank 38 for cooling when the measured temperature is above a predetermined value set on the cold water thermostat 42. The predetermined value is adjustable to change the desired temperature to which the water should be cooled. When the switch 58 is closed, the cold water pump 64 is activated to pump water from the water refrigeration tank 38 to the main supply tank 28 through the pipe 62. Thus, the water level in the water refrigeration tank 38 is reduced. The reduction in the water level of the water refrigeration tank 38 causes a float valve 46 to move away from the valve seat 44 thus opening the conduit 40 and allowing water to flow therethrough from the main water tank 28 to the water refrigeration tank 38. The float valve 46 is positioned in the conduit 40 to control the amount of water flowing into the water refrigeration tank 38. As more water enters the water refrigeration tank 38, the float valve 46 is caused to rise on top of the water and through the conduit 40 up towards the valve seat 44. Once the water in the main water tank 28 is cooled to the desired temperature, the pump 64 is turned off and no more water is pumped from the water refrigeration tank 38 to the main water tank 28. The water level in the water refrigeration tank 38 is thus caused to rise as water continues to flow through the conduit 40 until the float valve 46 closes the valve seat 44.

A compressor motor 48 is provided and connected to a refrigerant cooling coil 50 encircling the water refrigeration tank 38. The refrigerant cooling coil 50 is connected to a refrigerant radiator 52 and a fan 54 acts to cool refrigerant in the coil 50 at the position of the radiator 52. A cooling cycle timer 56 is provided for turning the cooling cycle on for a predetermined time during periods of non use such as during the winter months. The timer 56 thus ensures that the cooling cycle components, the pump 64 and the fan 54, are tested and do not incur long periods of non use which may affect operation of the cycle. The timer 56 is connected to a cold water cycle switch 58 which connects a source of power to the compressor motor 48, thereby turning the compressor motor 48 on by closing the cold water cycle switch 58 for a predetermined period and thereby helping to maintain the components of the cooling cycle, the pump 64 and the fan 54, in working order during long periods of inactivity and non use.

A cold water pumping pipe 62 is connected between the water refrigeration tank 38 and the main water tank 28. A water pump 64 is also provided for pumping water from the water refrigeration tank 38 through the cold water pumping pipe 62 and back to the main water tank 28 once cooled. The temperature of the water in the main water tank 28 is reduced by the introduction of cold water from the water refrigeration tank 38.

Figure 3:
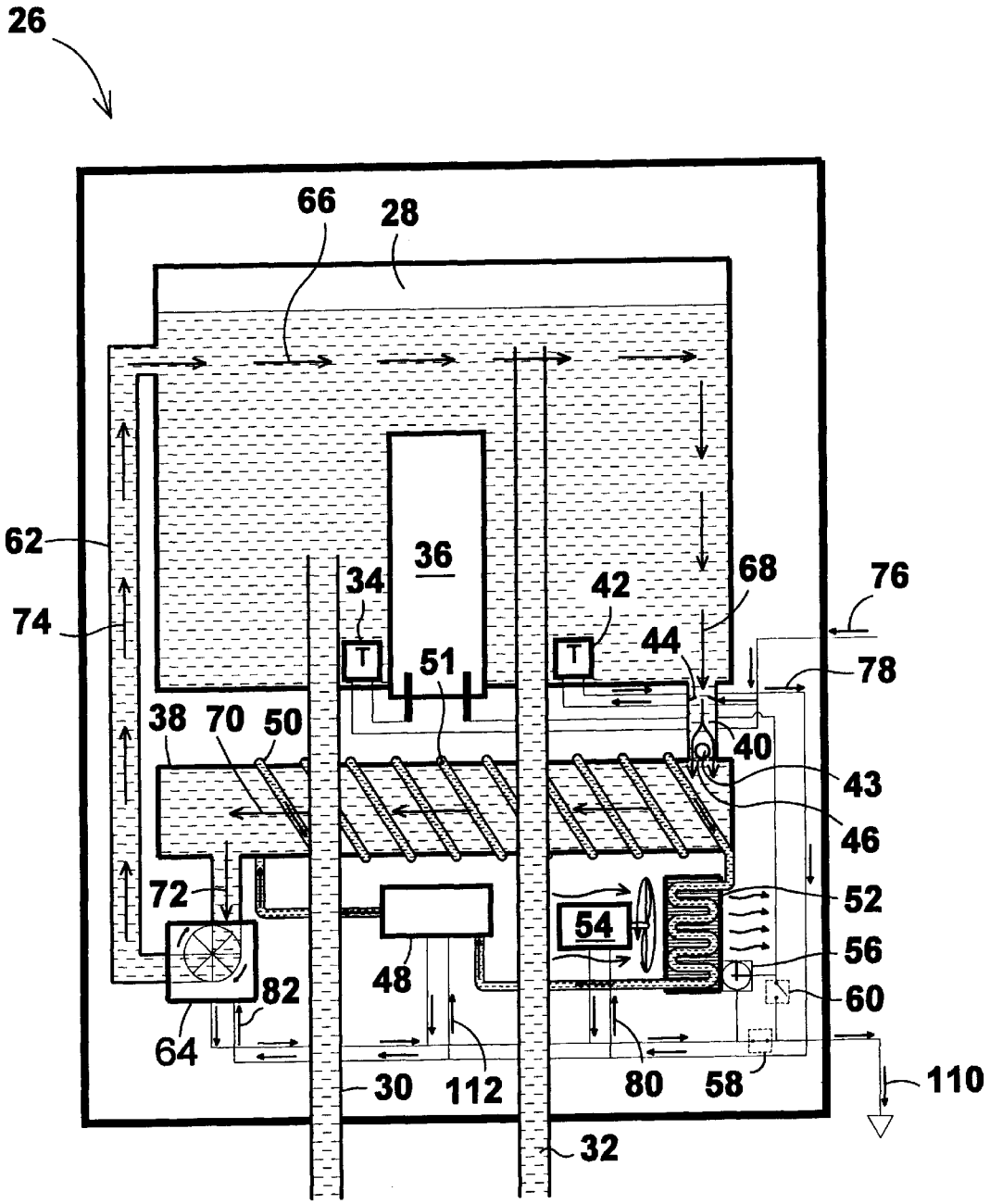
FIG. 3 is a representation of the activation of the cold water operating mode of the domestic water cooling and heating appliance of the temperature selectable water supply device of the present invention.

FIG. 3 illustrates operation of the cold water cooling cycle to cool the water in the main water tank 28 to a desired temperature for use. FIG. 4 illustrates operation of the hot water heating cycle with the cooling cycle turned off for heating the water in the main water tank 28 to a desired temperature for use. FIG. 5 illustrates operation of the hot water cooling cycle during a timer controlled maintenance cooling cycle. In this cycle, the timer turns the cooling cycle on for at least 5 seconds each day during winter months to maintain the proper operation of the cooling cycle components in proper working order. As the components of the cooling cycle are tested their operational status may be monitored and maintained.

The operation of the temperature selectable water supply device 20 will now be described with reference to the figures and specifically FIGS. 3–5. Prior to operation the temperature selectable water supply device 20 is installed within a room of a structure including a water outlet by connecting the main water tank 28 to the network of pipes 24 extending through the structure 14 via the water inlet pipe 30. The outlet is connected to the main water tank 28 through the water outlet pipe 32. The temperature selectable water supply device 20 is now ready for use.

Operation of the temperature selectable water supply device 20 during the cold water cycle operation with the cooling cycle on is illustrated in FIG. 3. During this cycle the active components of the temperature selectable water supply device 20 are the main water tank 28 (filled as indicated through inlet water pipe 30); the water refrigeration tank 38 (filled from main water tank 28 through float valve chamber 44), the water pump 64 and the pipes 40, 62 connecting the main water tank 28 and the water refrigeration tank 38. The refrigeration subsystem consists of the cooling fan; the refrigerant radiator; the compressor; the refrigerant tubing; and the refrigerant. The cooling cycle electric circuit consists of the cooling cycle thermostat; the main cooling cycle switch; the fan motor; the compressor motor; and the water pump.

During the cooling cycle, power is applied to the cold water thermostat 42 as indicated by the arrow labeled with the numeral 76. When the cold water thermostat determines that the water in the main water tank 28 is too warm, a current is allowed to pass through the cold water thermostat 42 as indicated by the numeral 78 and is applied to the switch 58 thereby closing the switch 58. Closing of the switch causes the valve seat 44 to be opened allowing water 66 in the main water tank 28 to flow through the conduit 40 as indicated by the arrow labeled with the numeral 68. The current passing through the cold water thermostat 42 is also applied to the compressor 48 as indicated by the arrow labeled 112, to the water pump 64 as indicated by the arrow labeled 82 and to the fan 54 as indicated by the arrow labeled 80. The current provided to the compressor 48, water pump 64 and fan 54 flows therethrough and through the switch 58 to a ground potential indicated by the arrow labeled with the numeral 110. Application of the current to the compressor 48 causes the compressor 48 to be turned on thereby causing the refrigerant 51 in the refrigerant cooling coil 50 to flow through the coil 50. The water flowing through the conduit 40 enters the water refrigeration tank 38 and is caused to flow therethrough by the water pump 64 as indicated by the arrow labeled with the numeral 70. As the refrigerant 51 flows through the refrigerant cooling coil 50, it passes through the refrigerant radiator 52 and in front of the fan 54 causing the refrigerant to be cooled. Thus, as the cooled refrigerant 51 passes through the refrigerant cooling coil 50 encircling the water refrigeration tank 38, the water flowing through the water refrigeration tank 38 is cooled. The water is drawn out of the water refrigeration tank 38 by the pump 64 as indicated by the arrow labeled with the numeral 72 and through the cold water pumping pipe 62 as indicated by the arrow labeled with the numeral 74 back to the main water tank 28. As the cold water being returned to the main water tank 28 mixes with the water within the main water tank 28 the water within the main water tank 28 is caused to be cooled. This process continues until the temperature of the water within the main water tank 28 measured by the cold water thermostat 42 substantially equals the desired temperature. At this point, the water has been cooled to the temperature desired for use and may be provided through the outlet and to the user. As the water is at a desired temperature, when a water tap in the structure is opened, water will be drawn from the main water tank 28 and through the outlet pipe 32 providing the water to the open tap. The pressure of the water may be controlled by the water pump 18 connected to the water tank 12 on the roof of the structure 14. When necessary water is supplied to the main water tank 28 from the water tank 12 on the roof of the structure 14 under control of the pump 18. The water is supplied to the main water tank 28 upon reaching a predetermined water level therein. Thus, the water level in the main tank 28 is not allowed to fall below a predetermined level.

The operation of the hot water cycle will now be described with specific reference to FIG. 4. During this cycle, the main water tank 28 and the water refrigeration tank 38 are both filled with water. As the cold water circulation system is off, the float valve 46 is closed preventing water from flowing into the water refrigeration tank 38. This protects the cold water system components from extensive contact with hot water during the winter season. The hot water cycle thermostat 34 is either on or off and the main hot water cycle switch 60 is on. During this cycle, the hot water thermostat 34 receives an electrical current indicated by the arrow labeled with the numerals 76 and 86 from a main power supply. When a temperature below the predetermined temperature is measured by the hot water thermostat 34, the thermostat 34 allows a current to flow therethrough to the heater 36 as indicated by the arrow labeled with the numeral 88 thereby turning the heater 36 on and heating the water in the main water tank 28. The current then flows through the hot water cycle switch 60 as indicated by the arrow labeled with the numeral 90 and to a ground potential as indicated by the arrow labeled 110. The heated water may now be supplied through the water outlet pipe 32 and the outlet connected thereto for use by a user.

FIG. 5 illustrates hot water cycle operation during a timer controlled maintenance cooling cycle. This function is used during the winter to maintain the proper functioning of the cooling cycle. This cycle operates identically to that illustrated in FIG. 4 with the additional function of turning the cooling cycle components on for a brief period of preferably 5 seconds to maintain the components in working order.

During the period in which the cooling cycle is tested, the cooling cycle electric circuit is activated by the electric timer 56. The timer 56 acts as a bypass for the cooling cycle switch 58 thereby closing the circuit and applying power to the cold water thermostat 42 as indicated by the arrow labeled with the numeral 76 which turns on due to the presence of heat produced by the heater 36. A current is passed through the cold water thermostat 42 as indicated by the arrow labeled with the numeral 90 and causes the valve seat 44 to be opened allowing water 94 in the main water tank 28 to flow through the conduit 40 as indicated by the arrow labeled with the numeral 96. The current passing through the cold water thermostat 42 is also applied to the compressor 48 as indicated by the arrow labeled 106, to the water pump 64 as indicated by the arrow labeled 108 and to the fan 54 as indicated by the numeral 104. This current flows through the fan 54 and then to the clock 56. From the clock 56 the current flows through the switch 60 and to a ground potential as indicated by the arrow labeled with the numeral 110. Application of the current to the compressor 48 causes the compressor 48 to be turned on thereby causing the refrigerant 51 in the refrigerant cooling coil 50 to flow through the coil 50. The water flowing through the conduit 40 enters the water refrigeration tank 38 and is caused to flow therethrough by the water pump 64 as indicated by the arrow labeled with the numeral 98. As the refrigerant flows through the refrigerant cooling coil 50, it passes through the refrigerant radiator 52 and in front of the fan 54 causing the refrigerant to be cooled. Thus, as the cooled refrigerant passes through the refrigerant cooling coil 50 encircling the water refrigeration tank 38, the water flowing through the water refrigeration tank 38 is cooled. The water is drawn out of the water refrigeration tank 38 by the pump 64 as indicated by the arrow labeled with the numeral 100 and through the cold water pumping pipe 62 back to the main water tank 28 as indicated by the arrow labeled with the numeral 102. This process continues until the timer period expires, normally a period of at least 5 seconds. The timer 56 then opens the circuit cutting off power to the compressor 48, water pump 64 and fan 54. The thermostat 42 is also turned off and the valve seat 44 is closed.

The temperature selectable water supply device 20 may be manufactured in different sizes to accommodate different water needs. The size of the main water tank 28 and the water refrigeration tank 38 may also vary. Preferably, the size of the device will be no larger than a conventional boiler which it may replace and the main water tank 28 will preferably retain about 60 liters therein. However, a main water tank 28 may be provided to retain more or less water as desired. The water is supplied to the main water tank from the water supply tank 12 on the roof of the structure 14 via gravity flow thereto. However, as the outlet connected to the temperature selectable water supply device 20 is opened, the pump 18 is controlled to supply water to the main water tank 28 at a desired pressure to replace the water being provided to the outlet. The temperature selectable water supply device 20 is thus able to handle water provided thereto under pressure and also provide water of any desired pressure to the outlet for use by a user.

From the above description it can be seen that the temperature selectable water supply device of the present invention is able to overcome the shortcomings of prior art devices by providing a temperature selectable water supply device which is able to provide a supply of water having a user selectable temperature control to a water outlet such as a faucet or toilet within a building. The temperature selectable water supply device includes a first water supply tank and a second cold water tank, the first water supply tank including a device for heating the contents thereof and a second cold water tank having a device for cooling the contents thereof. The temperature selectable water supply device is able to cool the water in the first water supply tank to a selectable temperature by injecting the contents of the second cold water supply tank until the desired temperature is achieved. Furthermore, the temperature selectable water supply device of the present invention is simple and easy to use and economical in cost to manufacture.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. An apparatus in combination with a domestic water supply for controlling the temperature of potable water being delivered for domestic use comprising:

a) a main water supply tank in a housing structure or room having an inlet conduit for receiving potable water from a domestic water supply and an outlet conduit for supplying the water at a predetermined temperature for domestic use in said housing structure or room;

b) first thermostatically controlled means connected to said main water supply tank for heating the water within said main water supply tank when a temperature of the water is below a first predetermined value;

c) a water refrigerating tank connected to directly receive and directly circulate back water from and to said main water supply tank; and d) second thermostatically controlled means for initiating circulation of water in said main water supply tank through said water refrigerating tank and cooling of water within said refrigeration tank when the temperature of the water in said main water supply tank is above a second predetermined value.

2. The apparatus as recited in claim 1, further comprising a conduit for delivering water in said main water tank to said water refrigerating tank.

3. The apparatus as recited in claim 2, further comprising a valve seat with a float valve positioned within said conduit and activated by said second thermostatically controlled means to allow water within said main water tank to pass therethrough and into said water refrigerating tank.

4. The apparatus as recited in claim 3, further comprising a float cage positioned at a connection between said conduit and said water refrigerating tank for retaining said float valve within said conduit.

5. The apparatus as recited in claim 1, wherein a cooling tube extends around said water refrigerating tank including a refrigerant positioned therein, a compressor for causing said refrigerant to flow through said cooling tube and means for cooling said refrigerant as said refrigerant flows through said cooling tube, said cooled refrigerant cooling said water refrigerating tank and any water flowing therethrough.

6. The apparatus as recited in claim 5, wherein said refrigerant cooling means includes a radiator through which a portion of said cooling tube extends and a fan positioned adjacent said radiator for cooling said refrigerant passing through said portion of said cooling tube extending through said radiator.

7. The apparatus as recited in claim 5, wherein said cooling tube spirals around said water refrigerating tank.

8. The apparatus as recited in claim 1, wherein a return pipe is connected between said water refrigeration tank and said main water tank and a pump is provided for drawing water into and through said return pipe.

9. The apparatus as recited in claim 1, further comprising a timer for activating cooling at predetermined times.

10. The apparatus as recited in claim 9, wherein said timer activates said cooling for a period of at least five seconds.

* * * * *